US011217269B2

(12) United States Patent
Song

(10) Patent No.: US 11,217,269 B2
(45) Date of Patent: Jan. 4, 2022

(54) METHOD AND APPARATUS FOR WIND NOISE ATTENUATION

(71) Applicant: Continental Automotive Systems, Inc., Auburn Hills, MI (US)

(72) Inventor: Jianming Song, Barrington, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 161 days.

(21) Appl. No.: 16/751,316

(22) Filed: Jan. 24, 2020

(65) Prior Publication Data

US 2021/0233557 A1 Jul. 29, 2021

(51) Int. Cl.

| | |
|---|---|
| ***G10L 25/84*** | (2013.01) |
| ***G10L 21/02*** | (2013.01) |
| ***G10L 25/18*** | (2013.01) |
| ***H04R 1/08*** | (2006.01) |

(52) U.S. Cl.

CPC ..... *G10L 25/84* (2013.01); *G10L 21/02* (2013.01); *G10L 25/18* (2013.01); *H04R 1/08* (2013.01); *H04R 2410/07* (2013.01)

(58) Field of Classification Search

CPC ..... G10L 25/84; G10L 25/18; G10L 21/0216; G10L 21/02; G10L 21/0232; G10L 15/20; G10L 15/22; G10L 2021/02166; G10L 2021/02161; H04R 1/08; H04R 1/406; H04R 3/005; H04R 2410/07

See application file for complete search history.

(56) References Cited

U.S. PATENT DOCUMENTS

| | | | | |
|---|---|---|---|---|
| 2012/0140946 | A1* | 6/2012 | Yen | H04R 1/1083 381/92 |
| 2017/0208407 | A1 | 7/2017 | Sapozhnykov | |
| 2018/0176704 | A1* | 6/2018 | Sapozhnykov | H04R 29/004 |
| 2019/0259381 | A1* | 8/2019 | Ebenezer | H04R 3/005 |

FOREIGN PATENT DOCUMENTS

| | | | |
|---|---|---|---|
| JP | 2005217749 | A | 8/2005 |
| KR | 20180085481 | A | 7/2018 |

OTHER PUBLICATIONS

Nelke et al. (Dual Microphone Wind Noise Reduction by Exploiting the Complex Coherence, Sep. 2014) https://ieeexplore.ieee.org/stamp/stamp.jsp?arnumber=6926045 (Year: 2014).*

International Search Report and Written Opinion dated Apr. 30, 2021 from corresponding International Patent Application No. PCT/US2021/014507.

Nima Yousefian et al. "A Dual-Microphone speech Enhancement Algorithm Based on the Coherence Function" IEEE Transactions on Audio, speech, and Language Processing, vol. 20, No. 2, Feb. 2012, pp. 599-609.

Christoph Mattias Nelke et al.; "Dual Microphone Wind Noise Reduction by Exploiting Complex Coherence" Speech Communications; 11, ITG Symposium, Sep. 2014, pp. 854-867.

* cited by examiner

*Primary Examiner* — Yogeshkumar Patel

(57) ABSTRACT

Approaches for detecting and reducing wind noise from audio signals captured at multi-microphone array are described. In aspects, the wind noise detector is constructed from probabilities of speech presence and wind noise presence, which are derives from statistics of the phase differences among the time aligned signals of multi-microphones in separate frequency regions. Wind noise, if detected, is reduced by a gain in frequency domain, which is also a function of the phase difference and its statistics.

20 Claims, 9 Drawing Sheets

METHOD AND APPARATUS FOR WIND NOISE ATTENUATION

TECHNICAL FIELD

This application relates to eliminating or reducing wind noise in signals detected by microphones.

BACKGROUND OF THE INVENTION

Wind noise (WN) is a major source of hearing interference in many environments, for example, for hearing aid or handsfree communication systems in cars. Wind noise is caused by turbulent airflow hitting the microphone membrane, which creates a strong audible signal mainly concentrated in a relatively low frequency region. A reliable and effective wind noise reduction (WNR) capability is important to allow these audio devices or voice communication systems to perform well under noisy conditions.

However, previous noise suppression methods fail to adequately remove wind noise. This is mainly because wind noise and speech are difficult to be differentiate through energy or SNR analysis in the time or frequency domains.

BRIEF DESCRIPTION OF THE DRAWINGS

For a more complete understanding of the disclosure, reference should be made to the following detailed description and accompanying drawings wherein.

Figure 1:
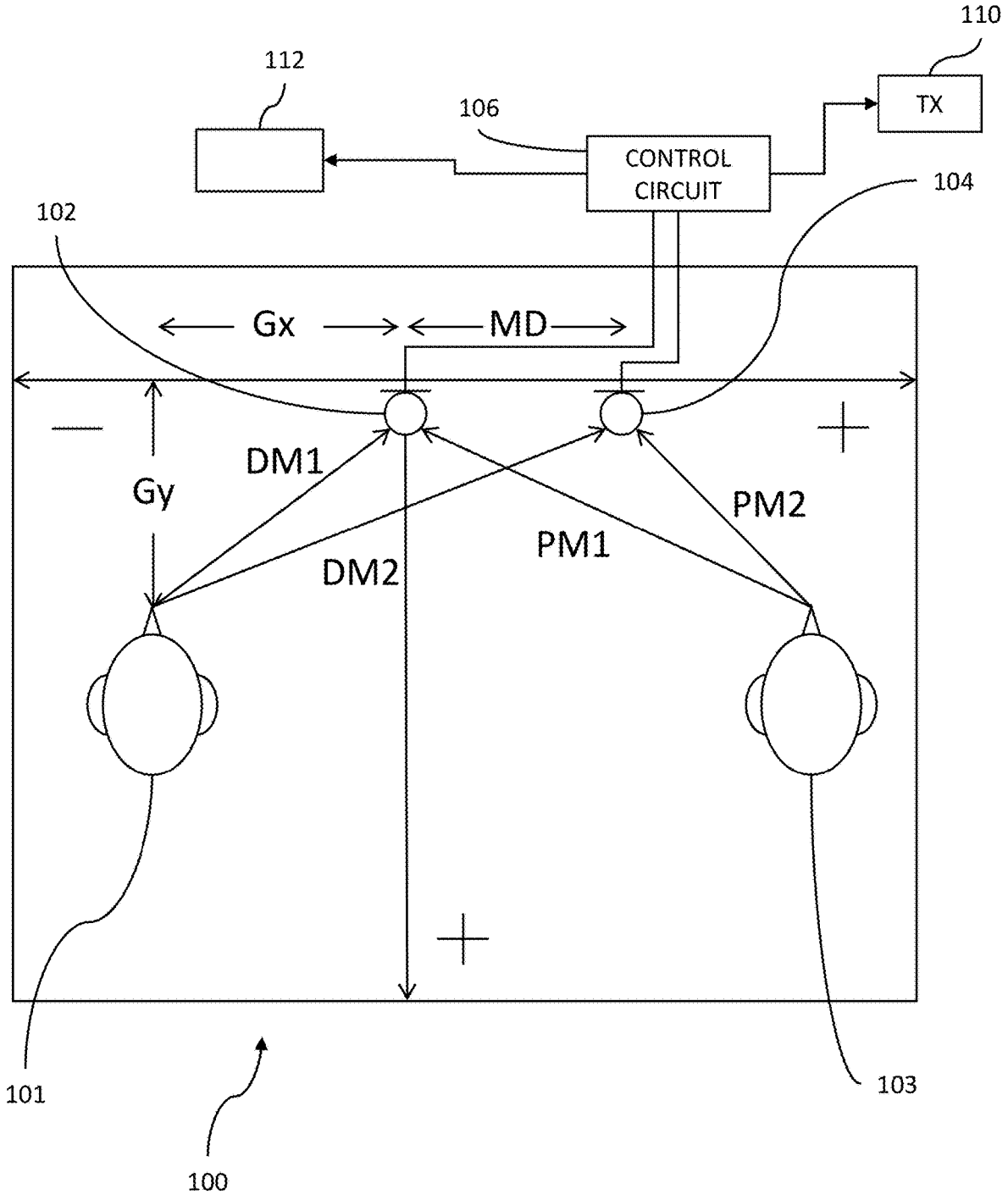
FIG. 1 comprises a diagram of a system for wind noise reduction according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The approaches described herein employ space selectivity and signal correlation properties at two or more microphones to determine wind noise in received signals. By making use of three properties in signal correlation present at different microphone locations (wind noise signal that is uncorrelated with speech signal, wind noise at different locations that is largely uncorrelated, and speech at all the microphones on a compact microphone array that are correlated), these approaches quickly construct a reliable wind noise detector, which classifies the microphone input at any given time as one of the four categories (wind noise, wind noise mixed with speech, speech and noise other than buffeting, e.g., conventional stationary noise).

In aspects and based upon the wind noise detection and/or classification result, this invention also creates and applies an effective wind noise attenuator for signals, e.g., two incoming microphone inputs. In aspects, the attenuation gain factor is derived from coherence, phase of the cross power spectrum of the two (or multi) microphone inputs, as well as probabilities of speech and wind noise estimated at wind noise detector. A comfort noise power spectrum generated from minimum statistics of the two microphone inputs can also be created and applied to the wind noise attenuated audio signal to eliminate noise gating effects. The application of the approaches provided herein removes wind noise rapidly and in significant amounts, while preserving speech quality.

In aspects, the present approaches embody multiple approaches and algorithms for two (or more) microphones based wind noise/speech detection and wind noise suppression. Various steps are performed.

In one approach, preprocessing is first performed. In aspects, a voice signal is captured at the two microphones in a car and each of the microphone signals is to be phase aligned. The phase alignment is done through a combination of a geometrical approach, which determines a constant time delay between the two signals originated from a voice source (e.g., driver or co-driver), and a delay calculated at run-time based on the cross-correlation of the two signals. Decision logic is used to determine whether the geometrically based static delay or dynamically calculated run-time delay is to be used for two signal phase alignment. Unlike previous approaches, this approach is reliable and more forgiving to inaccurate geometry measures or speakers (driver/codriver) position in the car.

Next, metrics for the measurement of wind noise and speech are created. Two metrics are created: probability of speech presence and probability of wind noise presence. In aspects, these metrics are probabilities since their value ranges between 0 and 1.

Unlike previous approaches which utilize energy or SNR (signal to noise ratio) for signal classification (e.g. speech, noise, etc.), these probabilities are used for speech/wind noise classification and are derived entirely from statistics of phase differences in multiple frequency regions. In the approaches described herein, a normalized variance of phase differences spreading across a certain frequency region is employed as a key parameter to discriminate speech from wind noise. These normalized variances are further used to construct probability of speech presence and probability of wind noise presence. This process occurs for each time interval (e.g., 10 ms~20 ms) at run time.

Then, speech and wind noise are detected and/or classified. The classifier/detector utilized herein utilizes decision logic (e.g., implemented as any combination of hardware or software), which is pre-trained (or off-line trained) using audio samples comprising speech only, wind noise only and speech/wind noise mixed data. At each short time interval (e.g., 10 ms~20 ms), two metrics, i.e., probability of speech and probability of wind noise, are both calculated which characterize the signal characteristics in different frequency regions. These two metrics are weighted separately and then linearly combined to form a single metric used for classification. The single metric is compared against three thresholds representing threshold for speech, threshold for wind noise, and thresholds where speech and wind noise occurs at the same time. In examples, these thresholds are determined from the off-line classifier training.

In aspects and in order to enhance the reliability of speech/wind noise classification frame by frame, and avoid sporadic classification error (which will lead annoying wind noise leaking after wind noise get suppressed), the approaches described herein employ a majority voting scheme, in that each classification result $c_t$ at frame t is pushed to a circular buffer of length N (e.g. N=10), along with (N−1) classification results from (N−1) previous frames. The signal class decision for the current frame t is made by majority voting, i.e., a final classification result is picked up for which its occurrences in the circular buffer appears most.

Next, a gain function is derived and applied. Unlike previous approaches for gain function construction (which solely utilize signal-to-noise ratio (SNR) information), the wind noise gain function utilized in the approaches described herein are a combination of a SNR and the normalized variance of phase difference which also plays a key role in wind noise/speech detection. The combination of SNR and phase information provides both spectral and spatial information and works much better than the conventional SNR that is only derived gain function for wind noise attenuation/speech preservation.

In many of these embodiments, a system includes a first microphone, a second microphone, and a control circuit. The first microphone obtains a first audio signal and the second microphone obtains a second audio signal. The first microphone is spatially separated from the second microphone.

The control circuit coupled to the first microphone and the second microphone, and is configured to: continuously and simultaneously segment the first audio signal that reaches the first microphone and the second audio signal that reaches the second microphones into time segments. For each of the time segments, the first audio signal that reaches the first microphone is formed into a first framed audio signal, and second audio signal that reaches the second microphone is formed into a second framed audio signal.

The control circuit is further configured to align the first framed audio signal and the second framed audio signal in time with respect to a targeted voice source. The time alignment of the first framed audio signal and the second framed audio signal is based on a static geometry-based measurement adjusted by a dynamic cross-correlation evaluation between signals received at the two microphones at run time.

The control circuit is also configured to perform a Fourier transform on each of the time aligned first framed audio signal to produce a first spectrum and the second framed audio signal to produce a second spectrum. Each of first spectrum and the second spectrum represents the spectrum of one of the two timed-aligned microphone signals at each of the time segments.

The control circuit is further configured to calculate phase differences between the first spectrum and the second spectrum at each of a plurality of frequencies according to a cross correlation of the first spectrum and the second spectrum. The control circuit is still further configured to determine a normalized variance of the phase differences in a defined frequency range for each of the time segments. The frequency range is calculated based on a microphone geometry, so that the error margin in the calculation of the normalized variance of the phase differences is minimized.

The control circuit is also configured to formulate and evaluate, at each of the time segments, a probability of speech presence and a probability of wind noise presence, based upon the normalized variance of the spectrum phase differences of the two time-aligned microphone signals. The control circuit is then configured to decide at each of the time segments a category for each time segment, wherein the category is one of: speech only, wind noise only, speech mixed with wind noise, or unknown, wherein decision logic is used to determine the category and the decision logic is based upon a first function which incorporates the individual and combined values of the probability of speech presence and probability of wind noise presence. The value of the first function is compared against a plurality of thresholds and make a wind noise detection decision. Based upon category that is determined, a wind attenuation action is selectively triggered.

When the action is to perform wind noise attenuation, the control circuit is configured to calculate a gain or attenuation function, the function being based upon the normalized variance of the phase differences and an individual phase difference at each of a plurality of frequencies in a predetermined frequency range. Wind noise attenuation is executed in frequency domain by multiplying the gain or attention function with a magnitude of each spectrum of the first spectrum and the second spectrum to produce a wind noise removed first spectrum and a wind noise removed second spectrum.

The control circuit is configured to then combine the wind noise removed first spectrum and the wind noise removed second spectrum to produce a combine spectra and construct a wind noise removed time domain signal by taking the inverse FFT of the combined spectra.

The control circuit potentially in combination with other entities can take an action using the time domain signal, the action being one or more of transmitting the time domain signal to an electronic device, controlling electronic equipment using the time domain signal, or interacting with electronic equipment using the time domain signal.

In aspects, the time segments are between 10 and 20 milliseconds in length. Other examples are possible.

In examples, the targeted voice source comprises a voice from a person sitting in the seat of a vehicle. Other examples of voice sources are possible.

In other examples, the probability of speech presence and the probability of wind noise presence each have a value between 0 and 1.

In other aspects, the determination of the category further utilizes a majority voting approach, which considers a current decision and a sequence of decisions in previous consecutive time segments. In other examples, the probability of speech presence and the probability of wind noise presence provide a metric, which is used to evaluate degrees of speech presence or wind noise presence, at each of the time segments.

In yet other aspects, the wind noise attenuation action is triggered when the decision that has been determined is wind noise only or wind noise mixed with speech. In still other examples, the values of the thresholds are estimated off-line through in an off-line algorithm training stage, using quantities of speech and wind noise samples.

In examples, the system is disposed at least in part in a vehicle. Other locations are possible. In some examples, the sound source moves while, in other examples, the sources are stationary or nearly stationary.

In others of these embodiments, an approach for wind noise reduction in microphone signals is provided.

A control circuit continuously and simultaneously segments a first audio signal that reaches a first microphone and a second audio signal that reaches a second microphones into time segments such that for each of the time segments. The first audio signal that reaches the first microphone is formed into a first framed audio signal, and second audio signal that reaches the second microphone is formed into a second framed audio signal.

The control circuit aligns the first framed audio signal and the second framed audio signal in time with respect to a targeted voice source. The time alignment of the first framed audio signal and the second framed audio signal is based on a static geometry-based measurement adjusted by a dynamic cross-correlation evaluation between signals received at the two microphones at run time.

The control circuit performs a Fourier transform on each of the time aligned first framed audio signal to produce a first spectrum and the second framed audio signal to produce a second spectrum. Each of first spectrum and the second spectrum represents the spectrum of one of the two timed-aligned microphone signals at each of the time segments.

The control circuit calculates phase differences between the first spectrum and the second spectrum at each of a plurality of frequencies according to a cross correlation of the first spectrum and the second spectrum.

The control circuit determines a normalized variance of the phase differences in a defined frequency range for each of the time segments. The frequency range is calculated based on a microphone geometry, so that the error margin in the calculation of the normalized variance of the phase differences is minimized.

The control circuit formulates and evaluates, at each of the time segments, a probability of speech presence and a probability of wind noise presence, based upon the normalized variance of the spectrum phase differences of the two time-aligned microphone signals. The control circuit decides at each of the time segments a category for each time segment, and the category is one of: speech only, wind noise only, speech mixed with wind noise, or unknown. Decision logic is used to determine the category and the decision logic is based upon a first function which incorporates the individual and combined values of the probability of speech presence and probability of wind noise presence. The value of the first function is compared against a plurality of thresholds and make a wind noise detection decision. Based upon category that is determined, a wind attenuation action is selectively triggered.

When the action is to perform wind noise attenuation, the control circuit calculates a gain or attenuation function. The function is based upon the normalized variance of the phase differences and an individual phase difference at each of a plurality of frequencies in a pre-determined frequency range. Wind noise attenuation is executed in frequency domain by multiplying the gain or attention function with a magnitude of each spectrum of the first spectrum and the second spectrum to produce a wind noise removed first spectrum and a wind noise removed second spectrum.

The control circuit combines the wind noise removed first spectrum and the wind noise removed second spectrum to produce a combine spectra. The control circuit constructs a wind noise removed time domain signal by taking the inverse FFT of the combined spectra.

An action is taken using the time domain signal. The action is one or more of transmitting the time domain signal to an electronic device, controlling electronic equipment using the time domain signal, or interacting with electronic equipment using the time domain signal. Other examples of actions are possible.

Referring now to FIG. 1, one example of a system for attenuating wind noise is described. A vehicle 100 includes a first microphone 102, a second microphone 104, a driver 101, and a passenger 103. The microphone 101 and 104 may couple to a control circuit 106.

The microphone 102 and 104 may be any type of microphone that, in aspects, detects human speech. In one example, the microphones 102 and 104 may be conventional analog microphones that sense human voice signal in the time domain and produce an analog signal representative of the detected voice. The vehicle 100 is any type of vehicle that transports humans such as an automobile or truck. Other examples are possible. Although two microphones are shown, it will be appreciated that these approaches are applicable for any number of microphones.

It will be appreciated that as used herein the term "control circuit" refers broadly to any microcontroller, computer, or processor-based device with processor, memory, and programmable input/output peripherals, which is generally designed to govern the operation of other components and devices. It is further understood to include common accompanying accessory devices, including memory, transceivers for communication with other components and devices, etc. These architectural options are well known and understood in the art and require no further description here. The control circuit 106 may be configured (for example, by using corresponding programming stored in a memory as will be well understood by those skilled in the art) to carry out one or more of the steps, actions, and/or functions described herein.

The control circuit 106 may be deployed at various locations in the vehicle 100. In one example, the control circuit 106 may be deployed at a vehicle control unit (e.g., that controls or monitors various functions at the vehicle 100). Generally speaking, the control circuit 106 determines whether wind noise exists in received microphone signals (as described below) and then selectively removes wind noise from these signals. After the wind noise is removed, the now-attenuated microphone signals can be used for other purposes (e.g., to perform actions at the vehicle 100).

The microphones 102 and 104 may be coupled to the control circuit 106 either by a wired connection or a wireless connection. The microphones 102 and 104 may also be deployed at various locations in the vehicle 100 depending upon the needs of the user and/or the system requirements.

In one example of the operation of the system of FIG. 1, the first microphone 102 obtains a first audio signal and the second microphone 104 obtains a second audio signal. The first microphone 102 is spatially separated from the second microphone 104.

The control circuit 106 is configured to: continuously and simultaneously segment the first audio signal that reaches the first microphone 102 and the second audio signal that reaches the second microphone 104 into time segments such that for each of the time segments. The first audio signal that reaches the first microphone 102 is formed into a first framed audio signal, and second audio signal that reaches the second microphone 104 is formed into a second framed audio signal.

The control circuit 106 is further configured to align the first framed audio signal and the second framed audio signal in time with respect to a targeted voice source. The time alignment of the first framed audio signal and the second framed audio signal is based on a static geometry-based measurement adjusted by a dynamic cross-correlation evaluation between signals received at the two microphones at run time.

The control circuit 106 is also configured to perform a Fourier transform on each of the time aligned first framed audio signal to produce a first spectrum and the second framed audio signal to produce a second spectrum. Each of first spectrum and the second spectrum represents the frequency spectrum of one of the two timed-aligned microphone signals at each of the time segments.

The control circuit 106 is further configured to calculate phase differences between the first spectrum and the second spectrum at each of a plurality of frequencies according to a cross correlation of the first spectrum and the second spectrum. The control circuit 106 is still further configured to determine a normalized variance of the phase differences in a defined frequency range for each of the time segments. The frequency range is calculated based on a microphone geometry, so that the error margin in the calculation of the normalized variance of the phase differences is minimized.

The control circuit 106 is also configured to formulate and evaluate, at each of the time segments, a probability of speech presence and a probability of wind noise presence, based upon the normalized variance of the spectrum phase differences of the two time-aligned microphone signals. The control circuit 106 is then configured to decide at each of the time segments a category for each time segment, wherein the category is one of: speech only, wind noise only, speech mixed with wind noise, or unknown, wherein decision logic is used to determine the category and the decision logic is based upon a first function which incorporates the individual and combined values of the probability of speech presence and probability of wind noise presence, wherein the value of the first function is compared against a plurality of thresholds and make a wind noise detection decision. Based upon category that is determined, a wind attenuation action is selectively triggered.

When the action is to perform wind noise attenuation, the control circuit 106 is configured to calculate a gain or attenuation function, the function being based upon the normalized variance of the phase differences and an individual phase difference at each of a plurality of frequencies in a pre-determined frequency range. Wind noise attenuation is executed in frequency domain by multiplying the gain or attention function with a magnitude of each spectrum of the first spectrum and the second spectrum to produce a wind noise removed first spectrum and a wind noise removed second spectrum.

The control circuit 106 is configured to then combine the wind noise removed first spectrum and the wind noise removed second spectrum to produce a combine spectra and construct a wind noise removed time domain signal by taking the inverse FFT of the combined spectra.

The control circuit 106 by itself or in combination with other entities can take an action using the time domain signal, the action being one or more of transmitting (using a transmitter 110) the time domain signal to an electronic device (e.g., an electronic device such as a smart phone, computer, laptop, or tablet), controlling electronic equipment (e.g., electronic equipment in the vehicle 100 such as audio systems, steering systems, or braking systems) using the final time domain signal, or interacting with electronic equipment using the time domain signal. In one example, a user may verbally instruct a radio to be activated and then control the volume on the radio. Other examples are possible.

In aspects, the time segments of the signals are between 10 and 20 milliseconds in length. Other examples are possible.

In examples, the targeted voice source comprises a voice from the driver 101 or the passenger 105 sitting in seats of a vehicle. Other examples of voice sources are possible.

In other examples, the probability of speech presence and the probability of wind noise presence each have a value between 0 and 1.

In other aspects, the determination of the category further utilizes a majority voting approach, which considers a current decision and a sequence of decisions in previous consecutive time segments. In other examples, the probability of speech presence and the probability of wind noise presence provide a metric, which is used to evaluate degrees of speech presence or wind noise presence, at each of the time segments.

In yet other aspects, the wind noise attenuation action is triggered when the decision that has been determined is wind noise only or wind noise mixed with speech. In still other examples, the values of the thresholds are estimated off-line through in an off-line algorithm training stage, using quantities of speech and wind noise samples. For example, this may be determined at a factory at system initialization.

In some examples, the sound sources (the driver 101 and the passenger 103) moves while, in other examples, the sources are stationary or nearly stationary.

Figure 2:
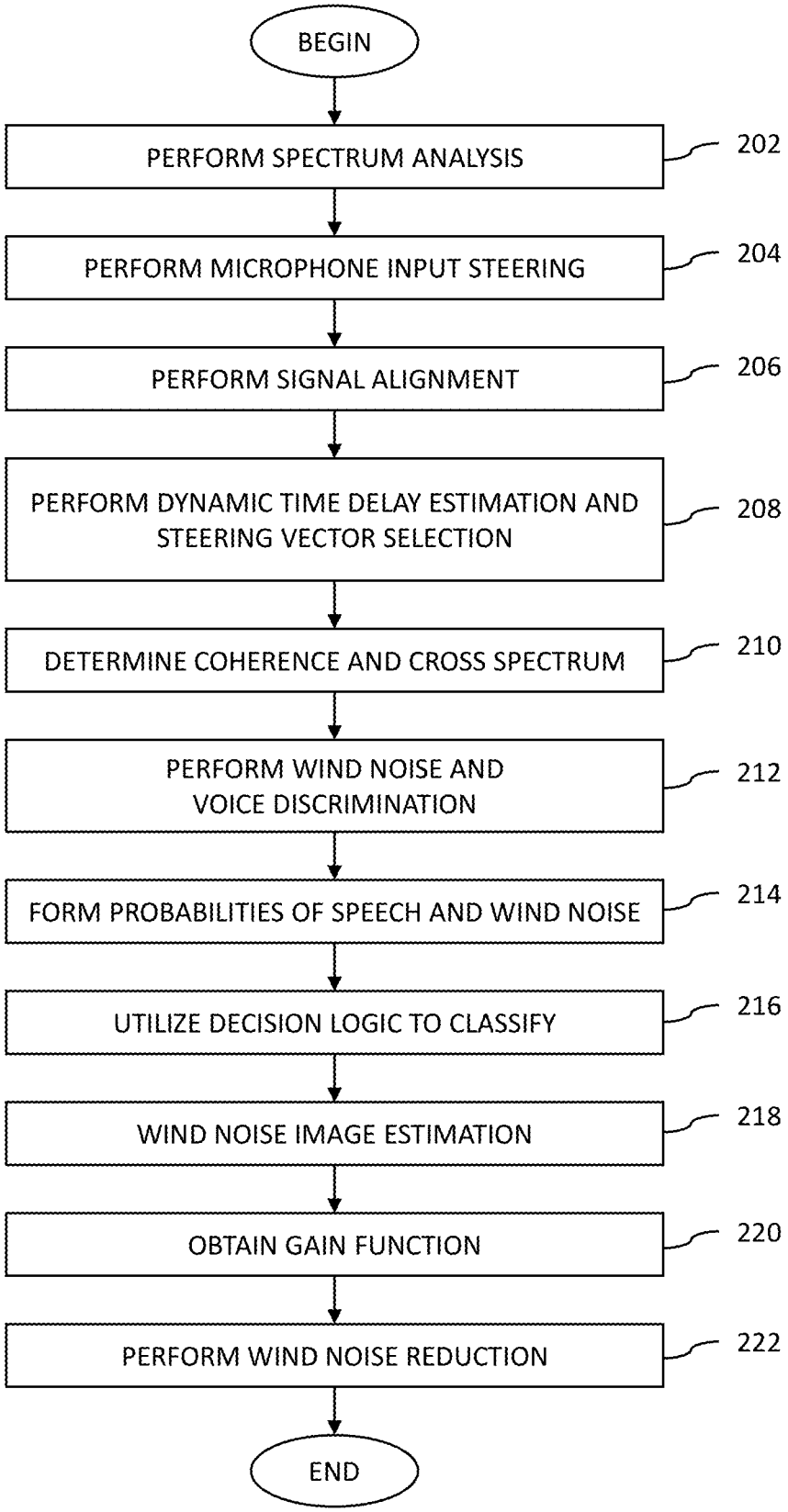
FIG. 2 comprises a flowchart of an approach for wind noise reduction according to various embodiments of the present invention.

Referring now to FIG. 2, one example of an approach for wind noise detection and attenuation is described.

At step 202, spectrum analysis is performed. In one example, each 10 ms of input signal coming from dual microphones $x_1(n),x_2(n)$ passes through an overlap-and-add process, to formulate a 20 ms frame with previous frame and produce spectrum equivalents $x_1(f),x_2(f)$ as representation of "raw" data to be processed.

At step 204, microphone input steering is performed. The algorithm keeps the two microphone inputs $x_1(f),x_2(f)$ aligned in phase. To this end, a steering vector derived from microphone geometry is calculated as part of system initialization. In aspects, the geometry based steering vector formation is similar but simpler than the one used in the fixed beam former (FBF).

In regards to microphone geometry, the two microphone array mounted inside the vehicle (typically on the center console overhead) is collinear and perpendicular with respect to the center axis of the vehicle. The microphone array geometry is defined by the driver and co-driver mouth-to-microphone distances as shown in FIG. 1. DM1 is the distance from the driver 101 to microphone 1 (102). PM2 is the distance from the co-driver or passenger 103 to microphone 2 (104). In practice, it is also assumed that the geometry is symmetric for driver 101 and front-seat passenger 103 with respect to the center axis of the vehicle, i.e. PM1=DM2, and PM2=DM1, etc.

Assuming the voice source in the vehicle is from the driver 101, and the effect of multi-paths for signal propagation to the two microphones 102 and 104 is negligible, the steering vector sv1 that phase aligns the voice signals is determined by:

$$sv1(f) = \begin{bmatrix} \alpha 1 e^{-i2\pi f \tau 1} \\ \alpha 2 e^{-i2\pi f \tau 2} \end{bmatrix}$$

τ1 τ2 are the signal propagation delays (in seconds) reaching microphone 1 and 2. a1 a2 are two factors related with individual normalized path loss.

The steering vector is simplified by assuming the delay of the signal propagation to the farthest microphone is zero, the steering vector becomes:

$$sv1(f) = \begin{bmatrix} \alpha 1 e^{-i2\pi f \tau} \\ \alpha 2 \end{bmatrix}$$

where τ is a relatively delay (a negative number in second) of the voice reaching to the closer microphone.

The (mouth) positions of driver 101 and passenger 103 with respect to the dual microphone array are assumed symmetric; the same steering vector formulated is applicable to both driver 101 and passenger 103.

Assuming voice source in the vehicle 100 is from the driver, and the effect of multi-paths for signal propagation to the two microphones 102 and 104 is negligible, the steering vector sv1 that phase aligns the voice signals is determined by:

$$sv1(f) = \begin{bmatrix} \alpha 1 e^{-i2\pi f \tau 1} \\ \alpha 2 e^{-i2\pi f \tau 2} \end{bmatrix}$$

τ1 τ2 are the signal propagation delays (in seconds) reaching microphone 1 and 2. a1 a2 are two factors related with individual normalized path loss.

The steering vector is simplified by assuming the delay of the signal propagation to the farthest microphone is zero, the steering vector becomes:

$$sv1(f) = \begin{bmatrix} \alpha 1 e^{-i2\pi f \tau} \\ \alpha 2 \end{bmatrix}$$

where τ is a relatively delay (a negative number in second) of the voice reaching to the closer microphone.

The (mouth) positions of driver 101 and passenger 103 with respect to the dual microphone array are assumed symmetric; the same steering vector formulated is applicable to both driver and codriver.

At step 206, signal alignment is performed. Given the steering vector derived from the microphone geometry, two microphone signals x1(*f*),x2(*f*) originated from driver or codriver are phase aligned in the look direction of driver and codriver by:

To the driver 103:

$$\begin{bmatrix} X1(f) \\ X2(f) \end{bmatrix} = \begin{bmatrix} x1(f)\alpha 1 e^{-i2\pi f \tau} \\ x2(f)\alpha 2 \end{bmatrix}$$

Or to the co-driver (passenger) 105:

$$\begin{bmatrix} X1(f) \\ X2(f) \end{bmatrix} = \begin{bmatrix} x1(f)\alpha 2 \\ x2(f)\alpha 1 e^{-i2\pi f \tau} \end{bmatrix}$$

At step 208, dynamic time delay estimation and steering vector selection are performed. The microphone geometry is measured once and becomes a fixed parameter for use every time. However, the distances from the driver 101 and the passenger 103 to the two microphones 102 and 104 may vary from time to time. Even the heights of driver/codriver may not be the same, which means the geometry measured no longer accurately applies. Therefore, the relative time delay calculated from the geometry should be acknowledged as "nominal" values, and there will be errors in phase alignment due to the geometry mismatch.

To mitigate this problem, time delay is estimated on-the-fly via the cross correlation of two microphone signals x1(*n*),x2(*n*) at each frame by:

$$R_{x1x2}(m) = \begin{cases} \sum_{n=0}^{N-m-1} x_1(n+m)x_2(n), & m \geq 0 \\ R_{x2x1}(-m), & m < 0 \end{cases}$$

where n and m are data sample indices.

The cross correlation $R_{x1x2}(m)$ calculated in the time domain is further normalized by the geometric mean of $R_{x1x1}(0)$ and $R_{x2x2}(0)$ to become cross correlation coefficient. The absolute value of the cross-correlation coefficients is confined to the interval [0, 1]:

$$R_{x1x2}(m) = R_{x1x2}(m)/\sqrt{R_{x1x1}(0)R_{x2x2}(0)}$$

$$0 \leq |R_{x1x2}(m)| \leq 1$$

As such, a valid time delay between x1 and x2 in the unit of sample can be estimated by:

$$\tau_d = \underset{\tau-\Delta<m<\tau+\Delta}{\operatorname{argmax}} \{R_{x1x2}(m)\}$$

$$\text{if } R_{x1x2}(\tau_d) > \text{thld_ } R_{x1x2}$$

$$\tau_d \text{ valid}$$

$$\text{else}$$

$$\tau_d \text{ invalid}$$

where τ_d, τ, Δ represent time delay in the unit of sample for dynamic, geometric and margin which is a maximum permissible deviation from the geometric τ. thld_$R_{x1x2}$ is a threshold (e.g. 0.60).

The delay τ_d, if valid, is converted from unit of sample to unit of second to construct a dynamic steering vector:

$$\tau_d = \tau_d / f_s$$

$$sv(f) = \begin{bmatrix} \alpha 1 e^{-i2\pi f \tau_d} \\ \alpha 2 \end{bmatrix}$$

where $f_s$ is sampling frequency in Hz.

The path losses are kept the same for the geometrically or dynamically constructed steering vector.

At each frame, if the dynamic delay calculated is valid, its corresponding steering vector is used for the signal alignment; otherwise the geometric derived steering vector is used. The dynamic $\tau_d$ calculation and its steering vector application mitigate possible errors in two signal alignments due to geometry mic-match and prevent occasional gross errors in dynamic time delay caused by numerical analysis.

At step 210, the coherence and cross spectrum of the signals are determined. Statistics of the two microphone signals exhibit a strong difference between wind noise and voice in the vehicle. Statistics useful are best represented by the coherence of two signals $X_1(f)$ and $X_2(f)$ defined as:

$$\Gamma(f) = \frac{X_1(f)X_2^*(f)}{\sqrt{X_1^2(f)X_2^2(f)}}$$

where { }* denotes a complex conjugate operator.

Because of short frame analysis, the cross power spectrum $X_1(f)X_2^*(f)$ is smoothed over time t as:

$$\Phi_{X_1X_2}(f,t)=\alpha\Phi_{X_1X_2}(f,t-1)+(1-\alpha)X_1(f,t)X_2^*(f,t)$$

where smoothing factor $\alpha$ is set to 0.5 in one example.

The phase of the cross power spectrum, which is, in some aspects, the most important statistic used for wind noise/speech detection, is calculated as:

$$\varphi(f) = \angle\Phi_{X_1X_2}(f,t) = \tan^{-1}\frac{\mathrm{Re}(\Phi_{X_1X_2}(f,t))}{\mathrm{Im}(\Phi_{X_1X_2}(f,t))}$$

where $X_1(f)$ and $X_2(f)$ are phase aligned by either geometric and dynamic steering vectors as discussed elsewhere herein.

At step 212, wind noise and voice discrimination (through phase analysis) are performed. In a vehicle, differentiation between wind noise and voice is explored from the phase of cross complex spectrum between two aligned signals $X_1(f)$ and $X_2(f)$. As voice signals are correlated while wind noise is not. For voice, the phase of cross spectrum is generally quite small, particularly in a low or medium frequency range (e.g., up to 2 kHz). On the other hand, for the case of wind noise the value of the phase of the cross spectrum is much larger and its variation across time and frequency is random.

For better wind noise and voice discrimination, the analysis frequency range is divided into two regions: the first one [(F_WN) from 10 Hz (F_WN_B) to 500 Hz (F_WN_E)] is primarily used for wind noise detection, the second one [F_SP from 600 Hz (F_SP_B) to 2000 Hz (F_SP_E)] is primarily used for voice detection.

As individual phase value at a time/frequency grid is meaningless, a statistics metric is created to characterize the phase. This metric is a normalized variance of cross spectrum phase defined as:

$$\sigma_\varphi = \frac{3}{\pi^2}\sum_{f=f1}^{f2}\frac{\varphi(f)^2}{f2-f1}$$

Two phase variances $\sigma_\varphi(wn)$ and $\sigma_\varphi(sp)$ are calculated respectively from one of the two frequency regions:

$\sigma_\varphi(wn)$ is from the region F_WN, f1=F_WN_B, f2=F_WN_E (e.g. f1=20 Hz, f2=500 Hz). $\sigma_\varphi(sp)$ is from the region F_SP, f1=F_SP_B, f2=F_SP_E (e.g. f1=500 Hz, f2=2000 Hz).

However, maximum frequency f2 in the region F_SP must be restricted so that:

$$f2 \le \frac{c}{2d}$$

where c and d are speed of sound and separation distance between two microphones.

Figure 3A:
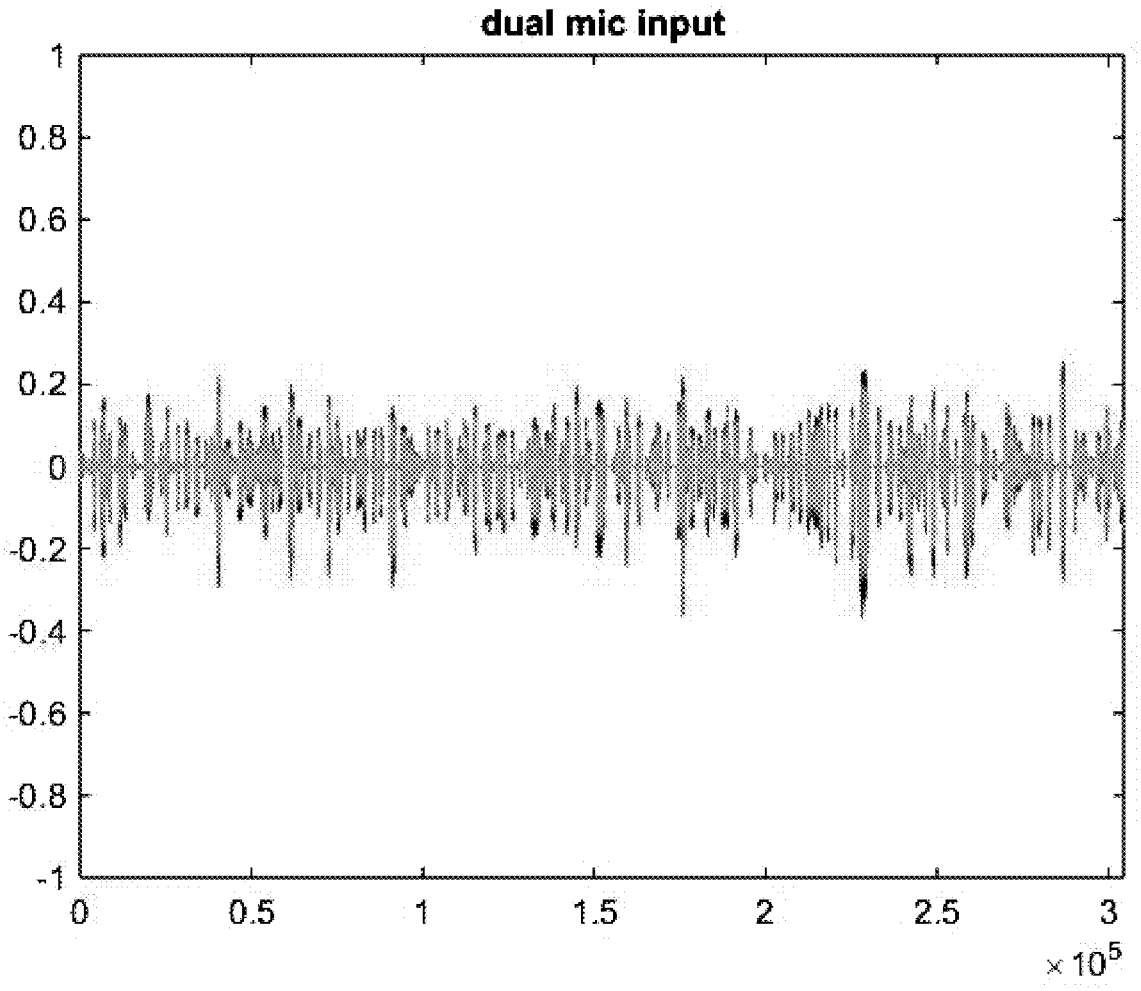
FIG. 3A displays dual microphone clean speech recorded in the car without buffeting, and FIG. 3B displays dual microphone buffeting in the car without speech presence.
Figure 3B:
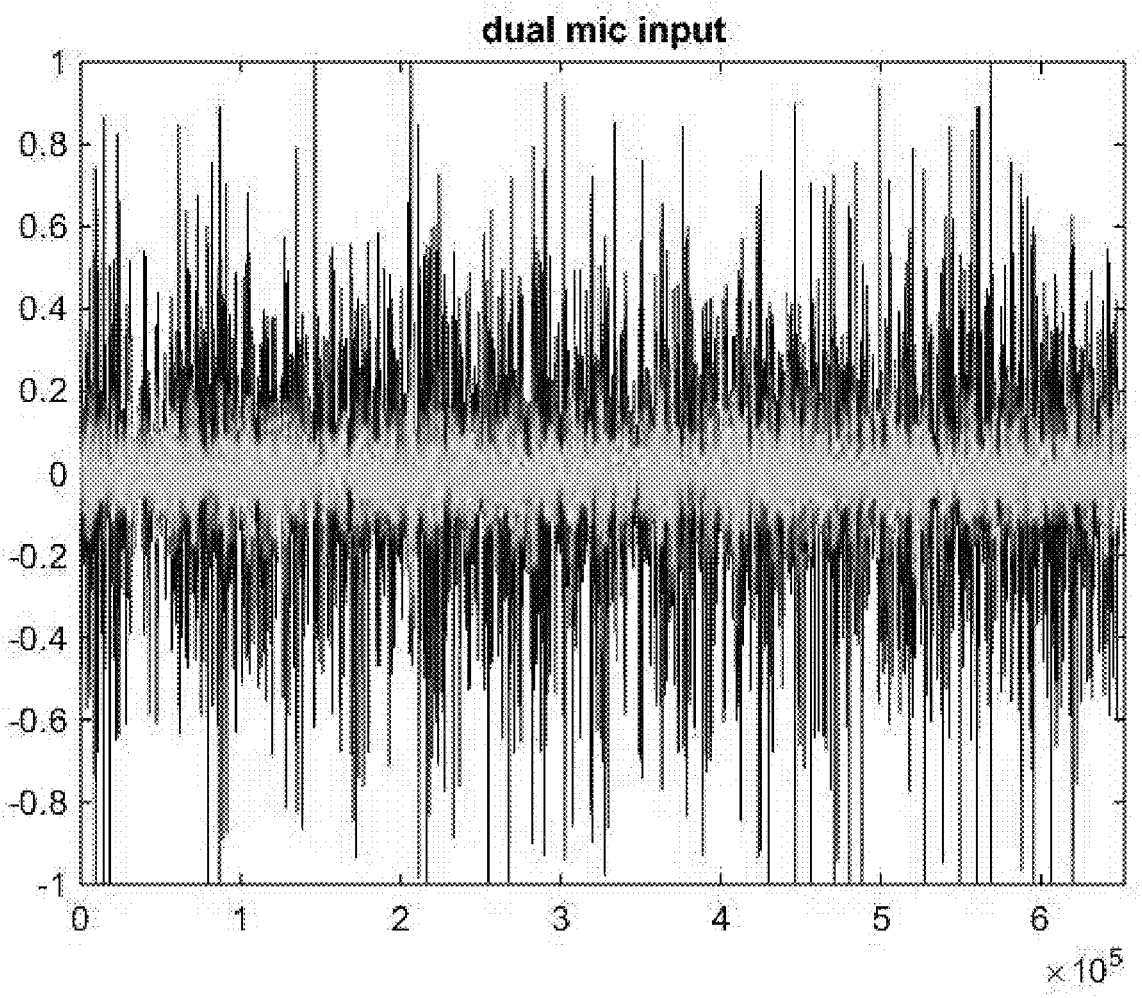

FIG. 3A displays dual microphone clean speech recorded in the car without buffeting, and FIG. 3B displays dual microphone buffeting in the car without speech presence.

Figure 4:
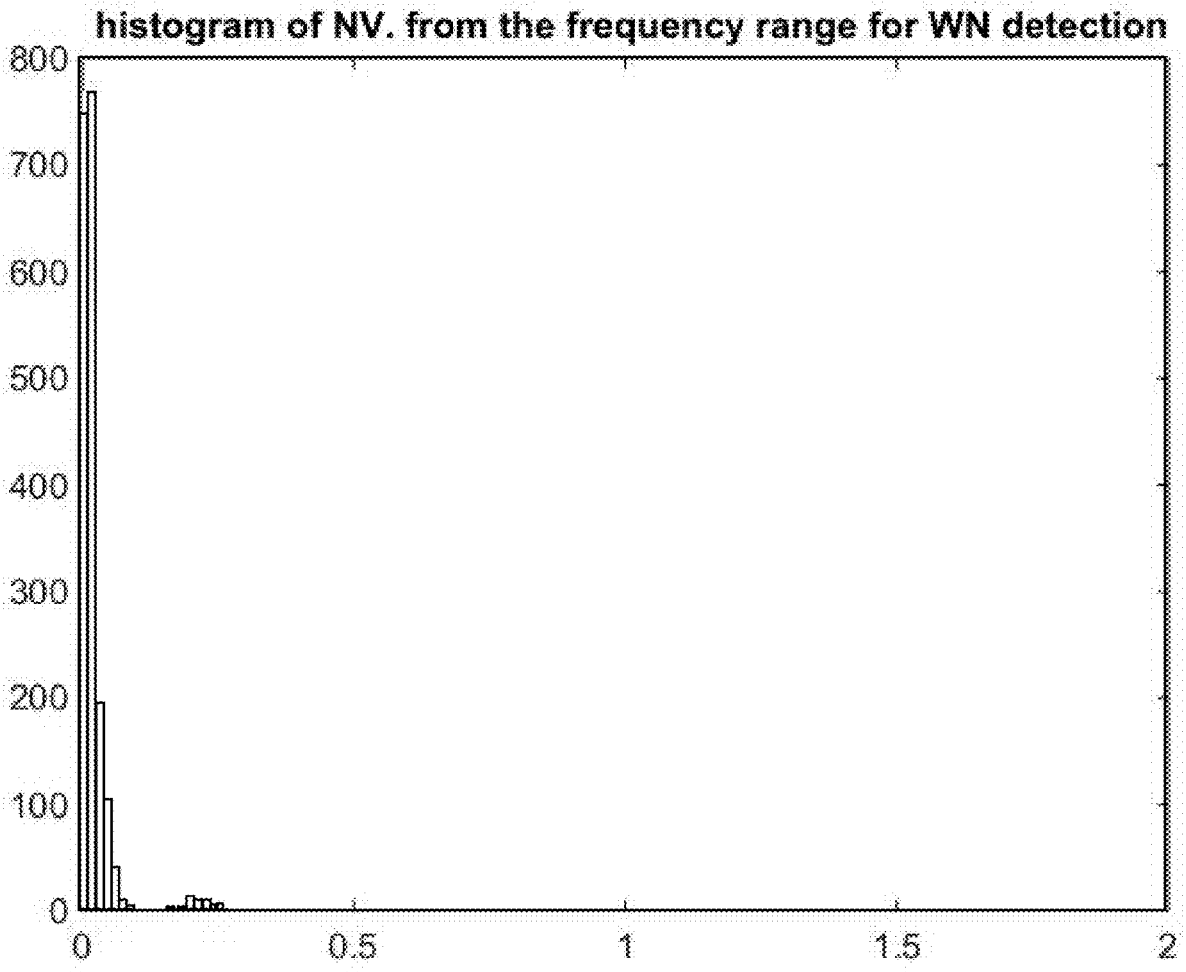
FIG. 4 comprises diagram illustrating aspects of the operation of the approaches described herein according to various embodiments of the present invention.
Figure 5:
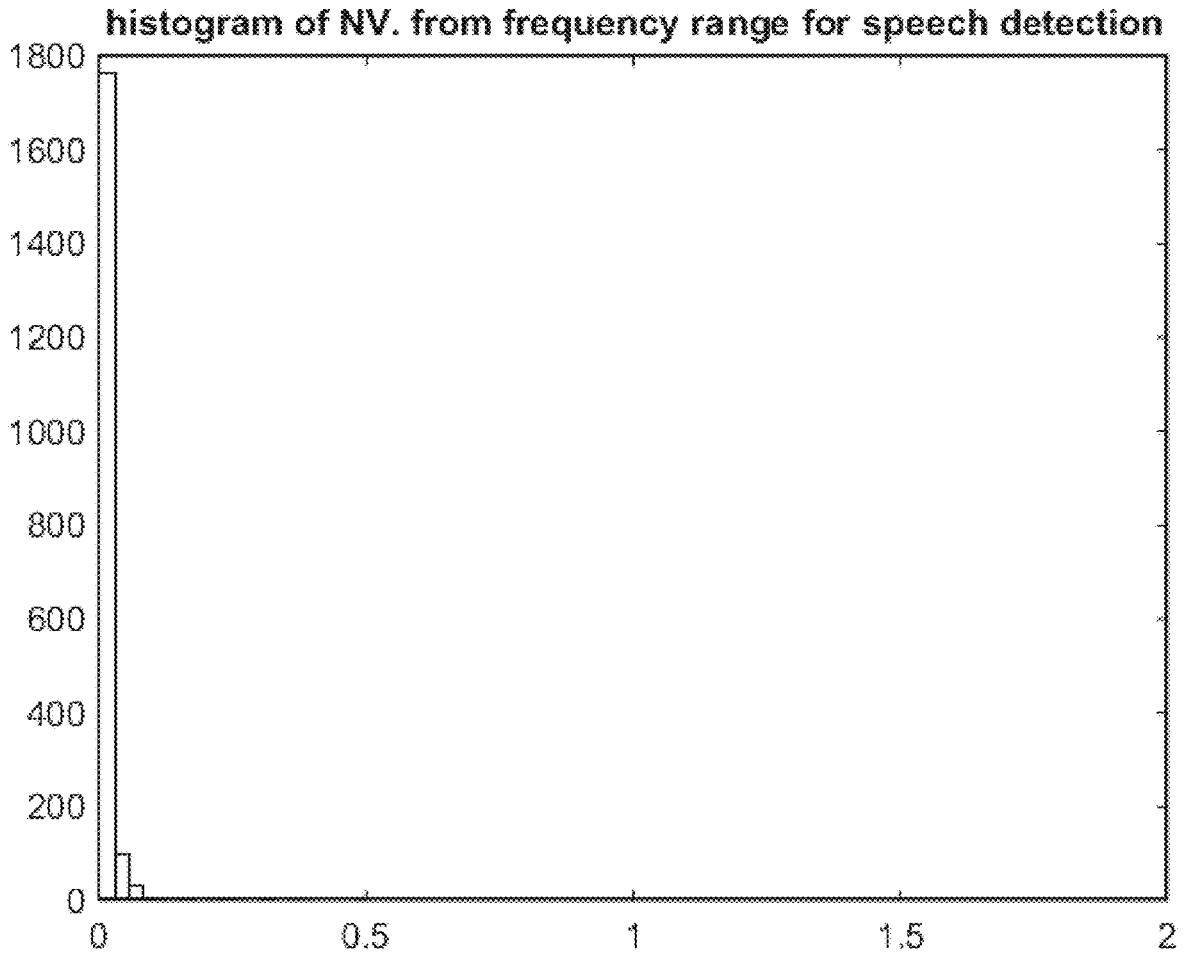
FIG. 5 comprises diagram illustrating aspects of the operation of the approaches described herein according to various embodiments of the present invention.
Figure 6:
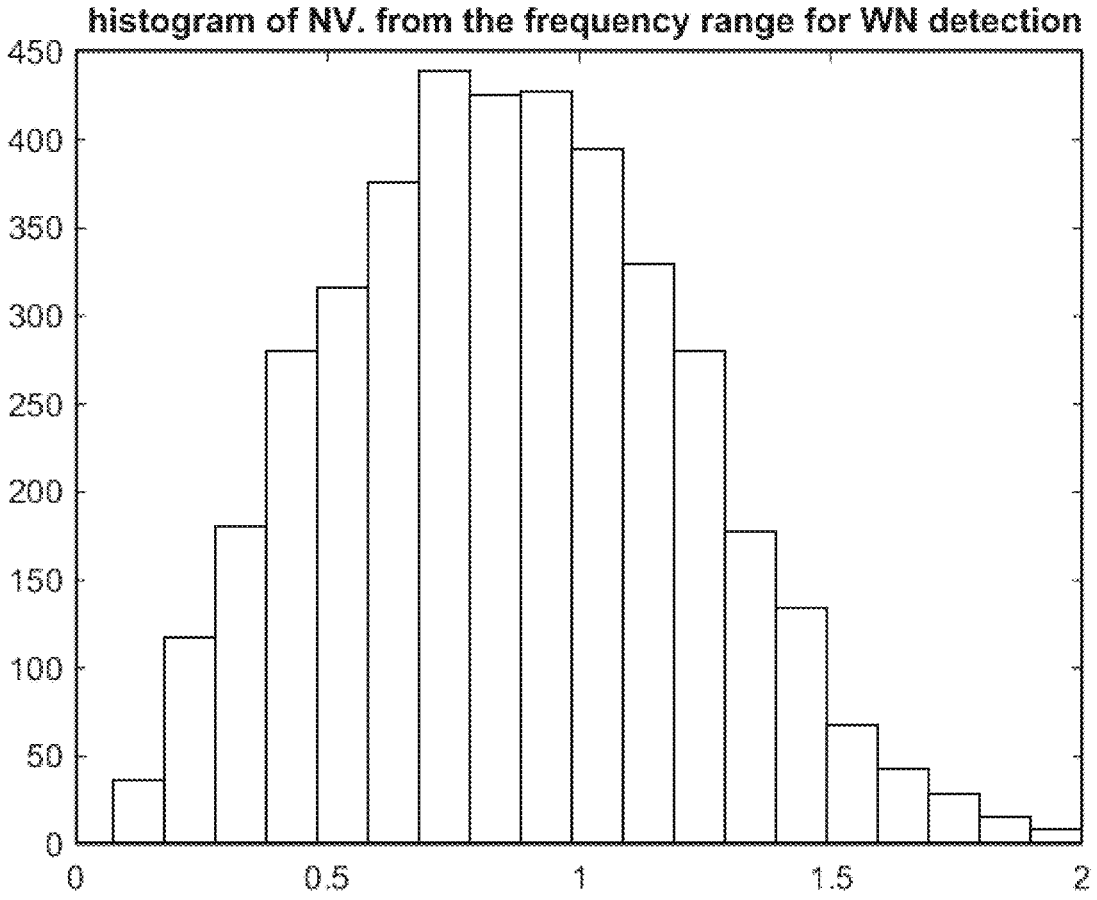
FIG. 6 comprises diagram illustrating aspects of the operation of the approaches described herein according to various embodiments of the present invention.
Figure 7:
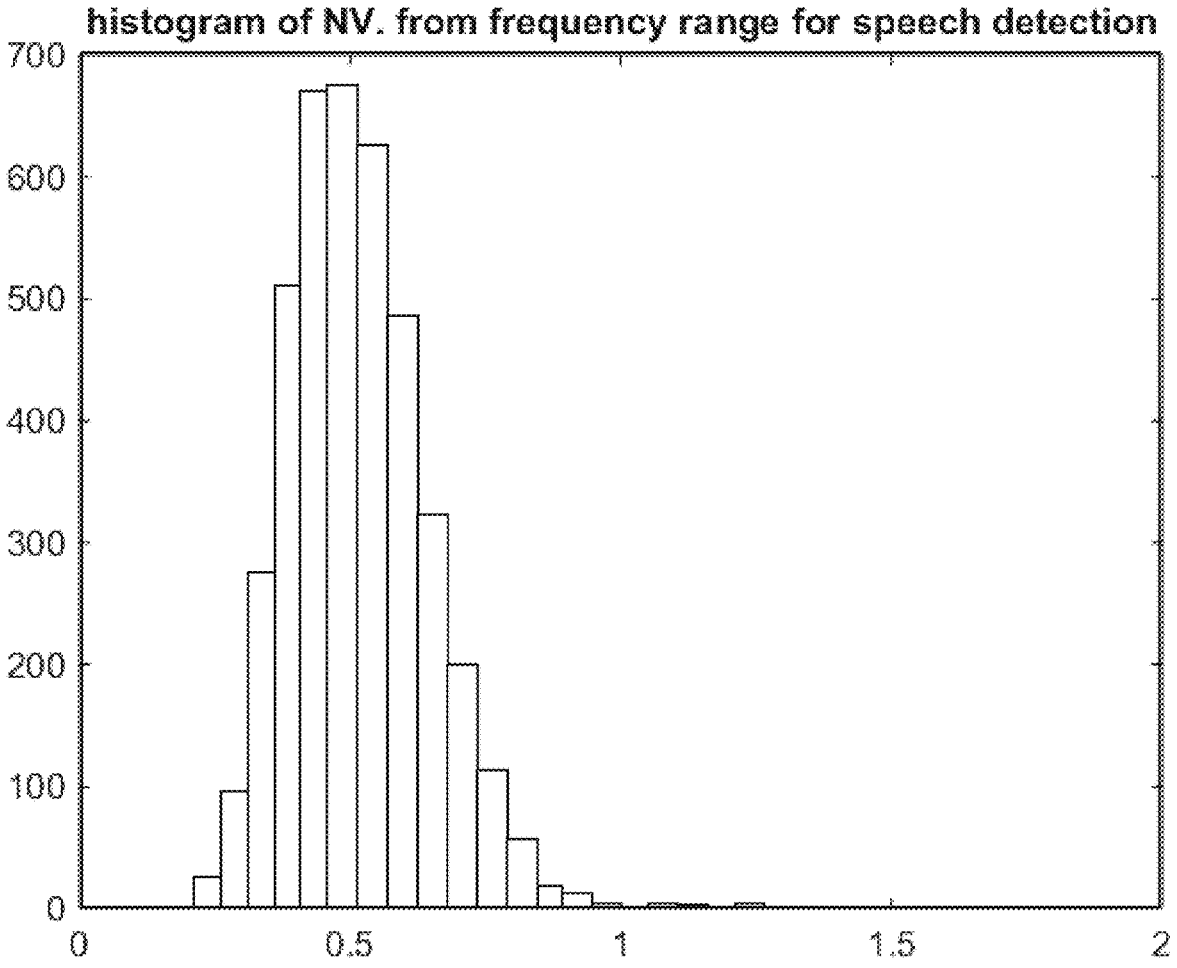
FIG. 7 comprises diagram illustrating aspects of the operation of the approaches described herein according to various embodiments of the present invention.

FIG. 4 and FIG. 5 (horizontal axis is variance, vertical axis is number of occurrences) present the normalized phase variance distributions (histograms) in the two frequency regions for the case of clean voice. Both $\sigma_\varphi(wn)$ and $\sigma_\varphi(sp)$ distributions are confined to an interval close to zero. On the other hand, as shown in FIG. 6 and FIG. 7, the two distributions for the case of wind noise are spread across a much broader interval. It is clear that voice and wind noise are separable in the view of the normalized phase variance.

Furthermore, through the analysis of these statistics, it can be concluded that the wind noise is easier to be detected in frequency region F_WN, while speech is easier to be identified in the frequency F_SP, especially when the wind noise and speech occur at the same time.

At step 214, formulation of probabilities of speech and wind noise occurs. To facilitate the wind noise/speech detection or identification, probability of speech and wind noise are calculated as:

$$prob_{wn} = \begin{cases} 0.0, & \text{if } \sigma_\varphi(wn) < \text{thld_min_}\sigma_\varphi \\ 1.0, & elif\,\sigma_\varphi(wn)) > \text{thld_max_}\sigma_\varphi \\ a\sigma_\varphi(wn) + b, & \text{else} \end{cases}$$

$$a = 1/(\text{thld_max_}\sigma_\varphi - \text{thld_min_}\sigma_\varphi)$$

$$b = -\text{thld_min_}\sigma_\varphi/(\text{thld_max_}\sigma_\varphi - \text{thld_min_}\sigma_\varphi)$$

$$prob_{sp} = \begin{cases} 1.0, & \text{if } \sigma_\varphi(sp) < \text{thld_min_}\sigma_\varphi \\ 0.0, & elif\,\sigma_\varphi(sp) > \text{thld_max_}\sigma_\varphi \\ a\sigma_\varphi(sp) + b, & \text{else} \end{cases}$$

$$a = -1/(\text{thld_max_}\sigma_\varphi - \text{thld_min_}\sigma_\varphi)$$

$$b = \text{thld_max_}\sigma_\varphi/(\text{thld_max_}\sigma_\varphi - \text{thld_min_}\sigma_\varphi)$$

where $\sigma_\varphi(wn)$, $\sigma_\varphi(sp)$ represent the normalized phase variances from region F_WN and F_SP respectively. thld_low_$\sigma_\varphi$, thld_high_$\sigma_\varphi$ are thresholds used to determine the probability of wind noise and probability of speech in their associated frequency regions.

At step 216, decision logic is utilized to classify wind noise, speech, or wind noise mixed with speech.

Wind noise and speech detection decision logic are calculated as:

```
if (α_sp prob_sp + α_wn(1.0 − prob_wn)) > thld_sp
    c ← SPEECH
else if (α_wn prob_wn + α_sp(1.0 − prob_sp)) > thld_wn
    c ← WN
else if (α_wn prob_wn + α_sp prob_sp) > thld_sp_wn
    c ← SPEECH_WN_MIXED
else
    c ← UNKNOWN
```

where thld_sp, thld_wn , thld_sp_wn are thresholds, $\alpha_{sp}$ and $\alpha_{wn}$ are weights and operator ← is assignment.

Instantaneous (i.e., per frame) classification result c is further denoised by consulting adjacent results. The current value $c_t$ at frame t, along with (N−1) decision results from (N−1) previous frames are stored in a circular buffer of length N (e.g. N=10). The final signal class decision for the current frame t is made by a so-called majority voting; a class is picked up for which its occurrences in the circular buffer appears most.

$$C_t = \text{majority}(c_{t-N-1}, c_{t-N-2}, \ldots c_t)$$

where $C_t$ is the final decision on signal class at frame t, while $c_{t-N-1}$, $c_{t-N-2}$, . . . $c_t$ are instantaneous classes computed for the current and (N−1) previous frames.

Figure 8:
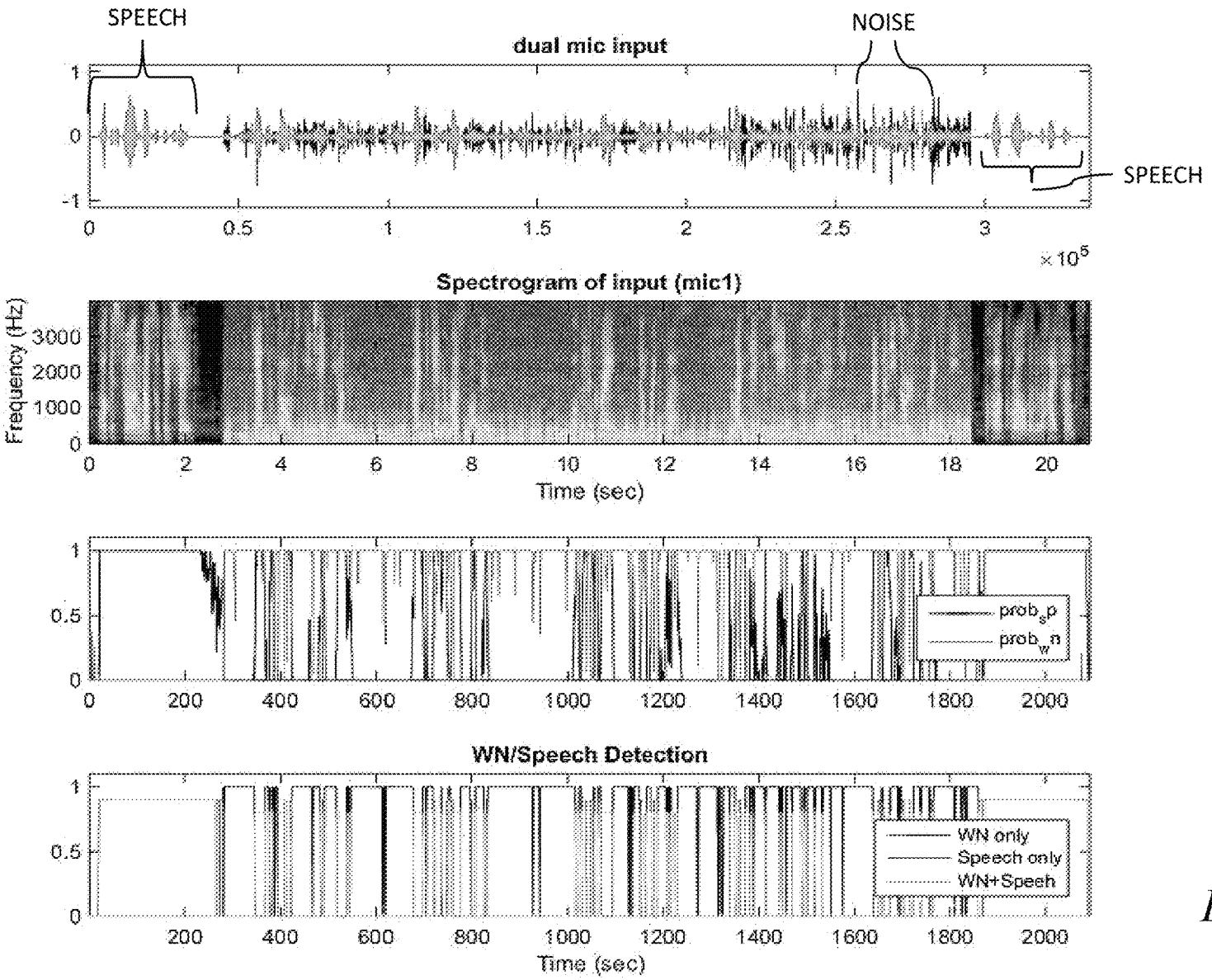
FIG. 8 comprises diagram illustrating aspects of the operation of the approaches described herein according to various embodiments of the present invention.

FIG. 8 highlights the results of probability estimates and signal classification for a dual microphone recording for which speech and wind noise are both present, except for the beginning and ending parts for which only speech is present. Examples of speech and wind noise are labeled in the figure. In this example, conventional noise category is merged with speech category, but wind noise only and wind noise mixed with speech are two separate categories. Both probability analysis and classification decisions shown in this figure match the true content in the recording (i.e., speech, wind noise, or wind noise mixed with speech). It can be seen that in aspects wind noise mixed with speech is correctly singled out almost all the time, by means of high values of both probability of wind noise and speech presence, and not confused with either speech or wind noise category.

Wind noise reduction can now occur. Wind noise reduction takes place when wind noise detector detects the presence of wind noise. A control circuit implementing wind noise reduction, in aspects, accomplishes or makes use of four functions: wind noise image estimation, wind noise reduction gain construction, comfort noise generation, wind noise reduction and comfort noise injection.

At step 218, wind noise image estimation is performed. Wind noise signals at the two microphones 102 and 104 are assumed to be uncorrelated, while voice signals are correlated. Furthermore, wind noise and voice signals are also uncorrelated. Therefore, a theoretical noise power spectrum density (PSD) can be formulated as:

$$\hat{\Phi}_N(t,f) = \sqrt{\Phi_{X1X1}(t,f)\Phi_{X2X2}(t,f)} - |\Phi_{X1X2}(t,f)|$$

where t, f are frame and frequency indices.

However, these assumptions do not always hold. For one reason, correctness of assumptions depends on microphone geometry. For example, the larger the microphone separation, the less correlation of the voice signals at the two microphones will be. The theoretical wind noise PSD tends to be underestimated. A more reliable and functional wind noise PSD is designed as a combination of the theoretical one and geometric mean of the auto PSD of X1 and X2, weighted by probabilities of speech and wind noise as follows:

$$\Phi_N(t,f) = \alpha\hat{\Phi}_N(t,f) + (1-\alpha)\sqrt{\Phi_{X1X1}(t,f)\Phi_{X2X2}(t,f)}$$

$$\alpha = \text{ALPHA}(\text{prob}_{wn} + (1 - \text{prob}_{sp}))$$

where ALPHA is a constant (0.4), $\text{prob}_{wn}$,$\text{prob}_{sp}$ are probabilities of wind noise and speech associated with the chosen look direction (towards driver or codriver).

In the conditions for which probability of wind noise is high and probability of speech is low, the wind noise PSD is approximately the same as the geometric mean of the two auto PSD of X1 and X2.

At step 220, a WNR gain function is determined. There are two different gain calculations designed and applied for wind noise reduction. The first one comes from a variant of the spectrum subtraction approach below:

$$G(f) = \max\left(\left(1 - \frac{\Phi_N(t,f)}{\sqrt{\Phi_{X1X1}(t,f)\Phi_{X2X2}(t,f)}}\right), G_{\min}\right)$$

where $\Phi_N(t,f)$ is the wind noise power spectrum that is estimated.

Minimum gain factor usually requires a much smaller value (e.g. −40 B) to effectively remove very strong wind noise. To better preserve speech even when noise is present, $G_{min}$ varies between $G_{min_min}$ and $G_{min_max}$, and is made as a function of the normalized phase variance $\sigma_\varphi(\text{wn})$ by:

$$G_{min} = \begin{cases} G_{min_min}, & \text{if } \sigma_\varphi(wm) > \text{thld_min_}\sigma_\varphi \\ G_{min_max}, & elif\, \sigma_\varphi(wm) < \text{thld_max_}\sigma_\varphi \\ a\sigma_\varphi(wm) + b, & \text{else} \end{cases}$$

$$a = (G_{min_min} - G_{min_max})/(\text{thld_max_}\sigma_\varphi - \text{thld_min_}\sigma_\varphi)$$

$$b = (G_{min_max}\text{thld_max_}\sigma_\varphi - G_{min_min}\text{thld_min_}\sigma_\varphi)/(\text{thld_max_}\sigma_\varphi - \text{thld_min_}\sigma_\varphi)$$

where $G_{min_min}$, $G_{min_min}$ are set to −40 dB and −20 dB respectively, representing minimum and maximum $G_{min}$. $\sigma_\varphi(\text{wn})$ is the normalized phase variance calculated from the frequency range assigned for wind noise detection, along with the thresholds thld_min_$\sigma_\varphi$, thld_max_$\sigma_\varphi$ discussed elsewhere herein.

As large value of the phase of the cross spectrum is a strong indicator of the wind noise presence, a second gain function is also derived as:

$$G_\varphi(f) = \begin{cases} 1.0, & \text{if } \varphi(f) < Q \\ G_{min_min}, & elif\, \varphi(f) > P \\ a\varphi(f) + b, & \text{else} \end{cases}$$

$$a = \frac{1}{(Q-P)},\ b = P/(P-Q)$$

$$P = \sqrt{\text{thld_max_}\sigma_\varphi \frac{\pi^2}{3}}$$

$$Q = \sqrt{\text{thld_min_}\sigma_\varphi \frac{\pi^2}{3}}$$

where thld_min_$\sigma_\varphi$, thld_max_$\sigma_\varphi$ are the same thresholds used above (with respect to probability determination) to calculate the probability of wind noise $\text{prob}_{wn}$ in the designated frequency range.

One advantage of this gain function is that it will ensure a deep attenuation to a time/frequency grid on both channels. This time/frequency grid is likely to have a wind noise presence as its associated phase of cross spectrum is unduly large.

The final and combined suppression rule which is used for WNR operation is as follows:

$$G_{WN}(f) = \min(G(f), G_\varphi(f))$$

At step 222, wind noise reduction is performed and it applies to both microphone channels as shown in FIG. 1. If wind noise detector detects a frame as wind noise only, or wind noise mixed with speech, WNR will be engaged and the computation is shown below $$X_i(f) = G_{WN}(f)X_i(f) + \alpha\text{Cn}(f), 1 \le i \le 2, f1 \le f \le f2$$

where $X_i(f)$ represents complex spectrum for virtual channel i and Cn(f) is a comfort noise pre-generated. f1, f2 represent the frequency range within which WNR takes place.

Comfort noise injection into the attenuated signal can also be utilized in the approaches described herein. As wind noise is usually deeply suppressed due to a very small gain value (e.g., −40 dB). A truly smoothed comfort noise needs to be created beforehand and injected to the point where the signal is heavily attenuated. For a stationary noisy condition, a comfort noise spectrum is created via a long term smoothed version of instantaneous noise estimated. However, because wind noise is strong, busty, and can last for a long time, the comfort noise generated in the conventional way has a noise gating effect and still wind noise like, therefore not suitable to add back to wind noise reduced signal.

For the wind noise reduction application, an alternative and more usable comfort noise is designed with the help of the minimum statistic approach. The minimum statistics operated at both channels efficiently and effectively locates a minimum value over an elapsed time for each frequency considered. It then assembles these unsynchronized minimum grids to formulate the "minimum" background noise for each channel.

The new comfort noise spectrum (envelope) is the average of the two minimum statistic collections from the two channels:

$$\mathrm{CnEnv}(f)=\tfrac{1}{2}\Sigma_{i=1}^{2}\ \mathrm{channe}[i]\rightarrow Smin[f]$$

where channe[i]→Smin[f] represents the minimum power spectrum value at frequency f associated with $i^{th}$ channel over a minimum statistic search time.

Like conventional comfort noise generation, the final comfort noise generation for WNR application is to apply the minimum statistics derived spectrum envelop to a piece of normalized white noise $N_w(f)$:

$$\mathrm{Cn}(f)=\mathrm{CnEnv}(f)N_w(f)$$

This new comfort noise generated may in fact apply to other places, such as one used after echo suppression.

After the wind noise has been removed from the signals, these signals may be converted back to the time domain and then utilized for other purposes. For example, these signals can be used to control the operation of other devices in the vehicle. In other examples, the signals may be transmitted to other users or devices. In yet other examples, the signals may be processed for other purposes.

It should be understood that any of the devices described herein (e.g., the control circuits, the controllers, the receivers, the transmitters, the sensors, any presentation or display devices, or the external devices) may use a computing device to implement various functionality and operation of these devices. In terms of hardware architecture, such a computing device can include but is not limited to a processor, a memory, and one or more input and/or output (I/O) device interface(s) that are communicatively coupled via a local interface. The local interface can include, for example but not limited to, one or more buses and/or other wired or wireless connections. The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory devices described herein can include any one or combination of volatile memory elements (e.g., random access memory (RAM), such as dynamic RAM (DRAM), static RAM (SRAM), synchronous dynamic RAM (SDRAM), video RAM (VRAM), and so forth)) and/or nonvolatile memory elements (e.g., read only memory (ROM), hard drive, tape, CD-ROM, and so forth). Moreover, the memory may incorporate electronic, magnetic, optical, and/or other types of storage media. The memory can also have a distributed architecture, where various components are situated remotely from one another, but can be accessed by the processor.

The software in any of the memory devices described herein may include one or more separate programs, each of which includes an ordered listing of executable instructions for implementing the functions described herein. When constructed as a source program, the program is translated via a compiler, assembler, interpreter, or the like, which may or may not be included within the memory.

It will be appreciated that any of the approaches described herein can be implemented at least in part as computer instructions stored on a computer media (e.g., a computer memory as described above) and these instructions can be executed on a processing device such as a microprocessor. However, these approaches can be implemented as any combination of electronic hardware and/or software.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A system, the system comprising:

a first microphone that obtains a first audio signal;

a second microphone that obtains a second audio signal;

wherein the first microphone is spatially separated from the second microphone;

a control circuit, the control circuit coupled to the first microphone and the second microphone, wherein the control circuit is configured to:

continuously and simultaneously segment the first audio signal that reaches the first microphone and the second audio signal that reaches the second microphone into time segments such that for each of the time segments, the first audio signal that reaches the first microphone is formed into a first framed audio signal, and second audio signal that reaches the second microphone is formed into a second framed audio signal;

align the first framed audio signal and the second framed audio signal in time with respect to a targeted voice source;

wherein the time alignment of the first framed audio signal and the second framed audio signal is based on a static geometry-based measurement adjusted by a dynamic cross-correlation evaluation between signals received at the two microphones at run time;

perform a Fourier transform on each of the time aligned first framed audio signal to produce a first spectrum and the second framed audio signal to produce a second spectrum, wherein each of first spectrum and the second spectrum represents the spectrum of one of the two timed-aligned microphone signals at each of the time segments;

calculate phase differences between the first spectrum and the second spectrum at each of a plurality of frequencies according to a cross correlation of the first spectrum and the second spectrum;

determine a normalized variance of the phase differences in a defined frequency range for each of the time segments, wherein the frequency range is calculated based on a microphone geometry, so that the error margin in the calculation of the normalized variance of the phase differences is minimized;

formulate and evaluate, at each of the time segments, a probability of speech presence and a probability of wind noise presence, based upon the normalized variance of the spectrum phase differences of the two time-aligned microphone signals;

decide at each of the time segments a category for each time segment, wherein the category is one of: speech only, wind noise only, speech mixed with wind noise, or unknown, wherein decision logic is used to determine the category and the decision logic is based upon a first function which incorporates the individual and combined values of the probability of speech presence and probability of wind noise presence, wherein the value of the first function is compared against a plurality of thresholds and make a wind noise detection decision, wherein based upon category that is determined, a wind attenuation action is selectively triggered;

when the action is to perform wind noise attenuation, calculate a gain or attenuation function, the function being based upon the normalized variance of the phase differences and an individual phase difference at each of a plurality of frequencies in a pre-determined frequency range, and wherein wind noise attenuation is executed in frequency domain by multiplying the gain or attention function with a magnitude of each spectrum of the first spectrum and the second spectrum to produce a wind noise removed first spectrum and a wind noise removed second spectrum;

combine the wind noise removed first spectrum and the wind noise removed second spectrum to produce a combine spectra;

construct a wind noise removed time domain signal by taking the inverse FFT of the combined spectra;

taking an action using the time domain signal, the action being one or more of transmitting the time domain signal to an electronic device, controlling electronic equipment using the time domain signal, or interacting with electronic equipment using the time domain signal.

2. The system of claim 1, wherein the time segments are between 10 and 20 milliseconds in length.

3. The system of claim 1, wherein the targeted voice source comprises a voice from a person sitting in the seat of a vehicle.

4. The system of claim 1, wherein the probability of speech presence and the probability of wind noise presence each have a value between 0 and 1.

5. The system of claim 1 wherein determination of the category further utilizes a majority voting approach, which considers a current decision and a sequence of decisions in previous consecutive time segments.

6. The system of claim 1, wherein the probability of speech presence and the probability of wind noise presence provide a metric, which is used to evaluate degrees of speech presence or wind noise presence, at each of the time segments.

7. The system of claim 1, wherein the wind noise attenuation action is triggered when the decision that has been determined is wind noise only or wind noise mixed with speech.

8. The system of claim 1, wherein the values of the thresholds are estimated off-line through in an off-line algorithm training stage, using quantities of speech and wind noise samples.

9. The system of claim 1, wherein the system is disposed at least in part in a vehicle.

10. The system of claim 1, wherein the sound source moves.

11. A method, the method comprising:

at a control circuit:

continuously and simultaneously segment a first audio signal that reaches a first microphone and a second audio signal that reaches a second microphone into time segments such that for each of the time segments, the first audio signal that reaches the first microphone is formed into a first framed audio signal, and second audio signal that reaches the second microphone is formed into a second framed audio signal;

align the first framed audio signal and the second framed audio signal in time with respect to a targeted voice source;

wherein the time alignment of the first framed audio signal and the second framed audio signal is based on a static geometry-based measurement adjusted by a dynamic cross-correlation evaluation between signals received at the two microphones at run time;

perform a Fourier transform on each of the time aligned first framed audio signal to produce a first spectrum and the second framed audio signal to produce a second spectrum, wherein each of first spectrum and the second spectrum represents the spectrum of one of the two timed-aligned microphone signals at each of the time segments;

calculate phase differences between the first spectrum and the second spectrum at each of a plurality of frequencies according to a cross correlation of the first spectrum and the second spectrum;

determine a normalized variance of the phase differences in a defined frequency range for each of the time segments, wherein the frequency range is calculated based on a microphone geometry, so that the error margin in the calculation of the normalized variance of the phase differences is minimized;

formulate and evaluate, at each of the time segments, a probability of speech presence and a probability of wind noise presence, based upon the normalized variance of the spectrum phase differences of the two time-aligned microphone signals;

decide at each of the time segments a category for each time segment, wherein the category is one of: speech only, wind noise only, speech mixed with wind noise, or unknown, wherein decision logic is used to determine the category and the decision logic is based upon a first function which incorporates the individual and combined values of the probability of speech presence and probability of wind noise presence, wherein the value of the first function is compared against a plurality of thresholds and make a wind noise detection decision, wherein based upon category that is determined, a wind attenuation action is selectively triggered;

when the action is to perform wind noise attenuation, calculate a gain or attenuation function, the function being based upon the normalized variance of the phase differences and an individual phase difference at each of a plurality of frequencies in a pre-determined frequency range, and wherein wind noise attenuation is executed in frequency domain by multiplying the gain or attention function with a magnitude of each spectrum of the first spectrum and the second spectrum to produce a wind noise removed first spectrum and a wind noise removed second spectrum;

combine the wind noise removed first spectrum and the wind noise removed second spectrum to produce a combine spectra;

construct a wind noise removed time domain signal by taking the inverse FFT of the combined spectra;

taking an action using the time domain signal, the action being one or more of transmitting the time domain signal to an electronic device, controlling electronic equipment using the time domain signal, or interacting with electronic equipment using the time domain signal.

12. The method of claim 11, wherein the time segments are between 10 and 20 milliseconds in length.

13. The method of claim 11, wherein the targeted voice source comprises a voice from a person sitting in the seat of a vehicle.

14. The method of claim 11, wherein the probability of speech presence and the probability of wind noise presence each have a value between 0 and 1.

15. The method of claim 11 wherein determination of the category further utilizes a majority voting approach, which considers a current decision and a sequence of decisions in previous consecutive time segments.

16. The method of claim 11, wherein the probability of speech presence and the probability of wind noise presence provide a metric, which is used to evaluate degrees of speech presence or wind noise presence, at each of the time segments.

17. The method of claim 11, wherein the wind noise attenuation action is triggered when the decision that has been determined is wind noise only or wind noise mixed with speech.

18. The method of claim 11, wherein the values of the thresholds are estimated off-line through in an off-line algorithm training stage, using quantities of speech and wind noise samples.

19. The method of claim 11, wherein the control circuit is disposed at least in part in a vehicle.

20. The method of claim 11, wherein the sound source moves.

* * * * *